US006595293B2

(12) United States Patent
Carter

(10) Patent No.: US 6,595,293 B2
(45) Date of Patent: Jul. 22, 2003

(54) APPARATUS AND METHOD FOR CONNECTING RISER BETWEEN A FLOATING VESSEL AND A SUBSEA STRUCTURE

(75) Inventor: Mark L. Carter, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 33 days.

(21) Appl. No.: 09/863,639

(22) Filed: May 23, 2001

(65) Prior Publication Data

US 2002/0176748 A1 Nov. 28, 2002

(51) Int. Cl.[7] ..... E21B 29/12; E02D 15/02

(52) U.S. Cl. ..... 166/345; 166/359; 166/350; 405/224.2; 405/224

(58) Field of Search ..... 166/350, 367, 166/359, 352, 345; 405/223.1, 224, 224.2, 195.1

(56) References Cited

U.S. PATENT DOCUMENTS 4,099,560 A * 7/1978 Fischer et al. ..... 138/106
4,100,752 A * 7/1978 Tucker ..... 405/170
4,176,986 A * 12/1979 Taft et al. ..... 166/350
4,266,886 A * 5/1981 Milton ..... 166/367
4,337,971 A * 7/1982 Kendrick ..... 285/315
4,436,451 A * 3/1984 Anderson ..... 166/355
4,673,041 A 6/1987 Turner et al. ..... 166/340
4,901,803 A * 2/1990 Levier ..... 166/340
5,881,815 A * 3/1999 Horton, III ..... 166/350
6,161,620 A * 12/2000 Cox et al. ..... 166/359
6,176,646 B1 1/2001 Finn et al. ..... 405/224.2
6,193,441 B1 2/2001 Fisher ..... 405/224.4
6,371,697 B2 * 4/2002 Huang et al. ..... 114/264
6,375,391 B1 * 4/2002 Borseth et al. ..... 114/264
6,435,775 B1 * 8/2002 Nish et al. ..... 114/264

* cited by examiner

*Primary Examiner*—Thomas B. Will
*Assistant Examiner*—Thomas A. Beach
(74) *Attorney, Agent, or Firm*—Michael P. Hartmann; Peter A. Bielinski

(57) ABSTRACT

A method and apparatus for connecting riser between a floating vessel and a subsea structure that reduces the size of the air tanks used and thereby allow closer positioning of the well slots and overall reduction in size of the floating vessel is disclosed. The apparatus includes an inverted hydraulically actuated connector positioned on the subsea structure and oriented to receive and sealingly attach to a complementary end connection member on the lower end of the riser string.

47 Claims, 6 Drawing Sheets

APPARATUS AND METHOD FOR CONNECTING RISER BETWEEN A FLOATING VESSEL AND A SUBSEA STRUCTURE

BACKGROUND OF THE INVENTION

1. Field of the Invention

This invention is generally related to a system for connecting a riser between a floating vessel and a subsea structure. More particularly, the invention provides apparatus and method for running a production riser to a subsea wellhead that reduces the size of the buoyancy air tanks in a deep draft caisson vessel and therefore the overall vessel size.

2. General Background

The ongoing search for hydrocarbons in offshore locations to satisfy the worlds increasing need for energy has led to the need to drill and produce these hydrocarbons in increasingly deeper waters. This has motivated the development of systems for drilling and producing hydrocarbons in ever deeper waters. Such systems have included the tension leg platform in which a buoyant structure is placed on the surface and anchored to the sea floor through pipes or tendons. The tension leg platform included means for ballasting and deballasting the platform to adjust the distance between the tension leg platform and the sea floor anchors for the tendons. This allows the tendons to be tensioned and act as a semi-rigid structure for maintaining the tension leg platform in position.

A second system developed for deep water drilling and production has been the spar or deep draft caisson vessel. This system uses in effect a long tube with a large sealed annular section that is positioned vertically. The sealed annular section of the deep draft caisson vessel includes a plurality of chambers that may be filled with water or air to control the buoyancy of the structure. A large central bore allows the positioning of well slots therein. As in the tension leg platform design, tubular members or risers as generally known in the industry extend from the sea floor to the surface structure.

It is important to minimize the size of the well slots and surrounding support structure to reduce the costs of the spar or deep draft caisson vessel. The current invention does this by reducing the through bore requirement in the buoyancy air tanks attached to the upper end of the riser and through which the riser is run. This is done by using an end connection member on the riser and providing a second hydraulic connector on the sea floor which can lock on the end connection member when it is deployed.

2. Description of Related Art

U.S. Pat. No. 4,673,041 to W. H. Turner et al. shows a hydraulically actuated connector used for well servicing on offshore wellhead systems.

A riser guide and support mechanism for use with a spar type floating vessel is disclosed in U.S. Pat. No. 6,176,646 B1 to L. D. Finn et al.

U.S. Pat. No. 6,193,441 B1 to E. A. Fisher shows an emergency dump apparatus for buoyancy air tanks.

SUMMARY OF THE INVENTION

The present invention comprises a riser with an end connection member that allows a smaller diameter through bore to be used in the buoyancy air tank through which it is run. The system is especially useful in a spar type structure or a deep draft caisson vessel that uses large diameter air tanks to tension the riser. A subsea structure such as a template or wellhead base is positioned on the sea floor and anchored thereto. A subsea wellhead housing is affixed to the subsea structure. A hydraulically actuated connector is sealingly connected to the subsea wellhead housing and a second hydraulically actuated connector is positioned above the first hydraulically actuated connector. The second hydraulically actuated connector may be connected to the first hydraulically actuated connector by conventional means as bolting or clamping or may be integrally formed together. The second hydraulically actuated connector is positioned facing upward to receive the aforementioned end connection member on the riser and lock thereon.

The floating vessel or deep draft caisson vessel positioned above the subsea wellhead includes a plurality of well slots. The well slots have air tanks or cans positioned therein with the air tanks secured together in end to end arrangement. Each of the well slots include guide sleeves positioned vertically along the well slot to restrain movement of the air tanks. The air tanks have a through bore through which the riser may pass. A stem joint extends from the top of the uppermost air tank. A riser stop is positioned on the stem joint and coacts with the lower framework of the deep draft caisson vessel to limit upward movement of the air tanks when deballasted.

Alternative embodiments are shown with mechanical connectors replacing the hydraulic connectors. Electrical connectors also are envisioned. Additionally, an embodiment with the lower connector integrally formed with the wellhead housing is shown.

A wellhead housing and christmas tree are connected to the upper end of the riser and rest on stem joint to allow tensioning of the riser as described. A method of operation is also described and claimed.

A principal object of the present invention is to provide an apparatus that reduces the size of the air tanks used on a deep draft caisson vessel and thereby allow closer positioning of the well slots and overall reduction in size of the deep draft caisson vessel.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENTS

Figure 1:
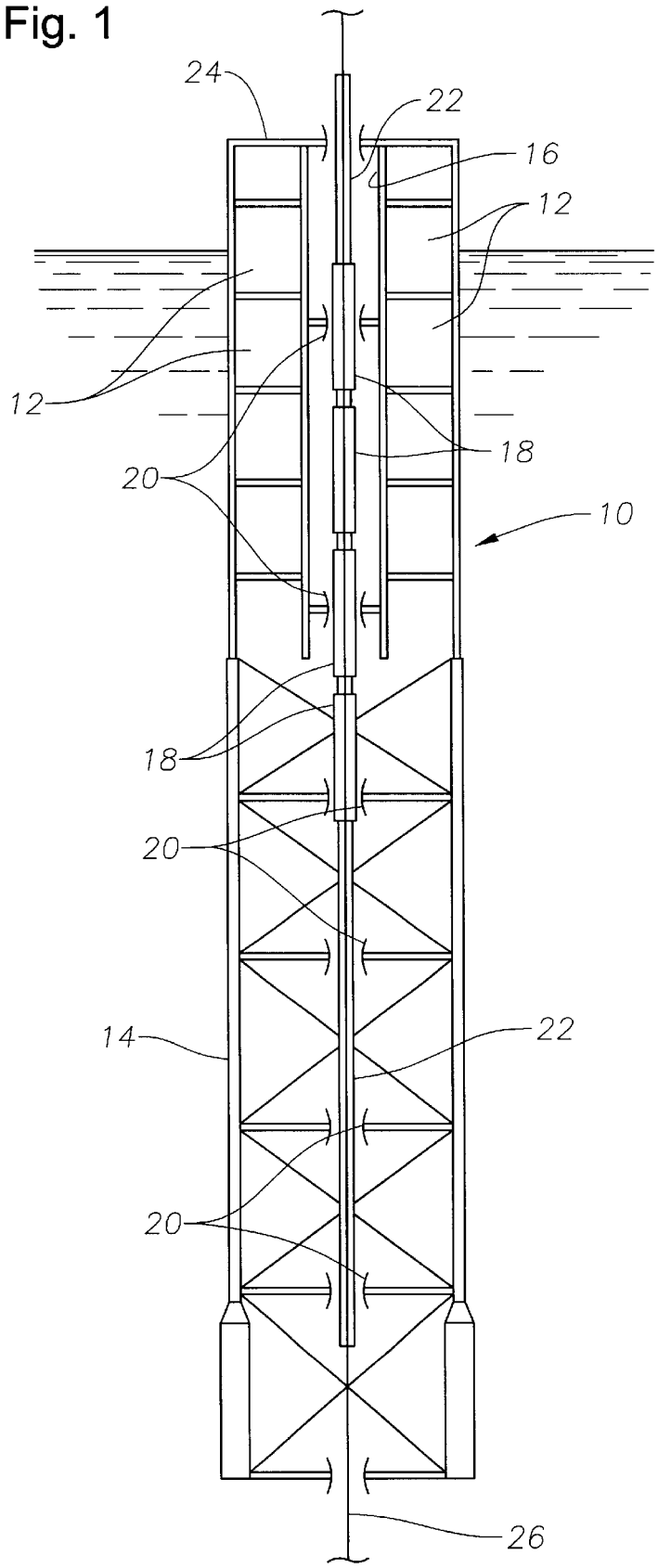
FIG. 1 is an elevation view of a typical deep draft caisson vessel that uses the present invention.

With reference to the drawings, and particularly to FIG. 1, an elevation view of a floating vessel 10, commonly referred to as a spar structure or deep draft caisson vessel, that utilizes the present invention therein is shown. Floating vessel 10 includes buoyancy chambers 12 that provide buoyancy to support floating vessel 10 with its associated top deck and support equipment in a vertical position as shown. Floating vessel or deep draft caisson vessel 10 is a massive structure typically 500 to 600 feet in depth. Lower framework 14 of floating vessel 10 is a truss framework, well known to those of ordinary skill in the art. A plurality of well slots 16 are centrally located on floating vessel 10 with a single one shown in FIG. 1. Well slot 16 has a plurality of buoyancy air tanks 18 positioned therein in end to end arrangement. Buoyancy air tanks 18 are secured together at their ends by suitable connections means as bolting.

Positioned vertically along well slot 16 are guide sleeves 20 that serve to centralize buoyancy air tanks 18. Uppermost buoyancy air tank 18 has a tubular member or stem joint 22 secured thereto and extending upwardly to spar deck 24. Extending below buoyancy air tanks 18 are further stem joints 22 extending to the lower section of floating vessel 10 with riser string 26 extending therefrom to the sea floor.

Figure 2A:
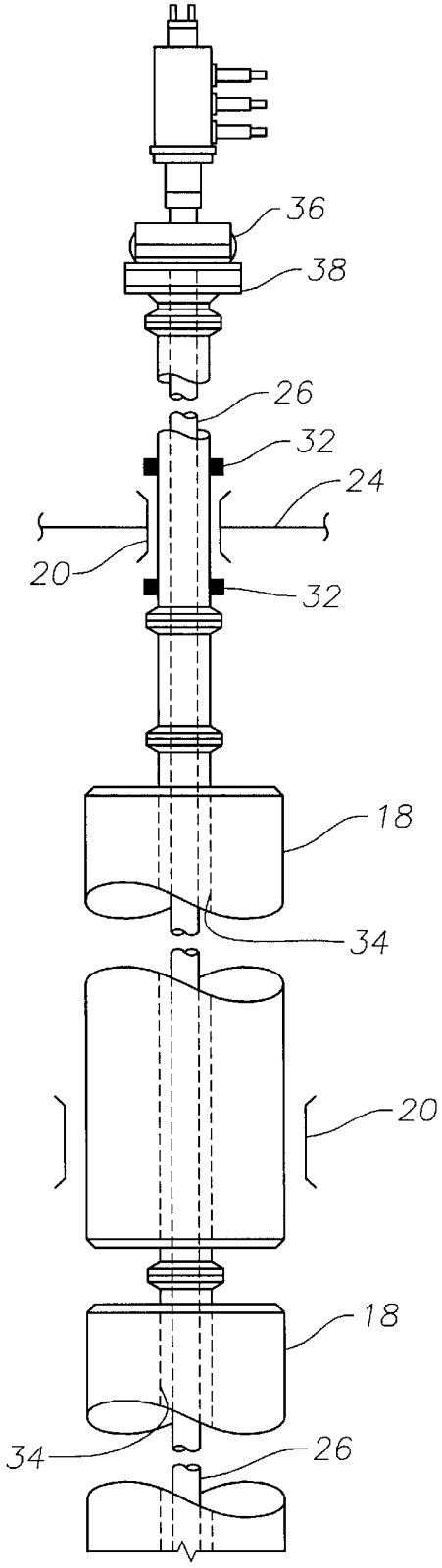
FIGS. 2A and 2B are an elevation view of the overall system of the present invention showing the relationship of the deep draft caisson vessel and subsea structure.
Figure 2B:
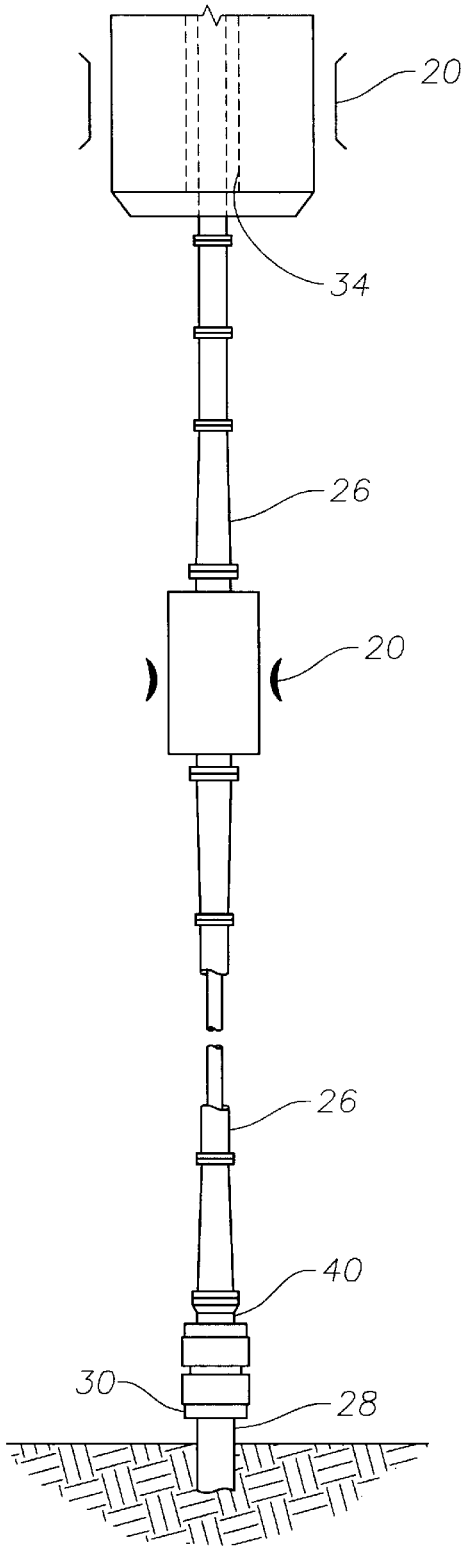

FIGS. 2A and 2B show in greater detail the relationship of stem joints 22, floating vessel 10, riser string 26 and subsea structure 28. Subsea structure 28 is typically a subsea template or permanent guide base or similar structure to which subsea wellhead housing 30 is secured and thereby anchored to the sea floor. It is to subsea wellhead housing 30 to which it is desired to connect riser string 26.

At spar deck 24 are positioned stem joint stops 32 to limit upward movement of buoyancy air tanks 18 when the tanks are deballasted. Buoyancy air tanks 18 have bore 34 extending therethrough. Bore 34 is sized to allow passage of riser string 26. The upper end of riser string 26 terminates at wellhead housing 36 which is sealingly connected to riser string 26. Wellhead housing 36 in turn rests on flange 38 of the upper end of stem joint 22. Thus as buoyancy air tanks 18 are deballasted and rise, tension is applied to riser string 26 to maintain it in a vertically tensioned positioned.

Figure 3:
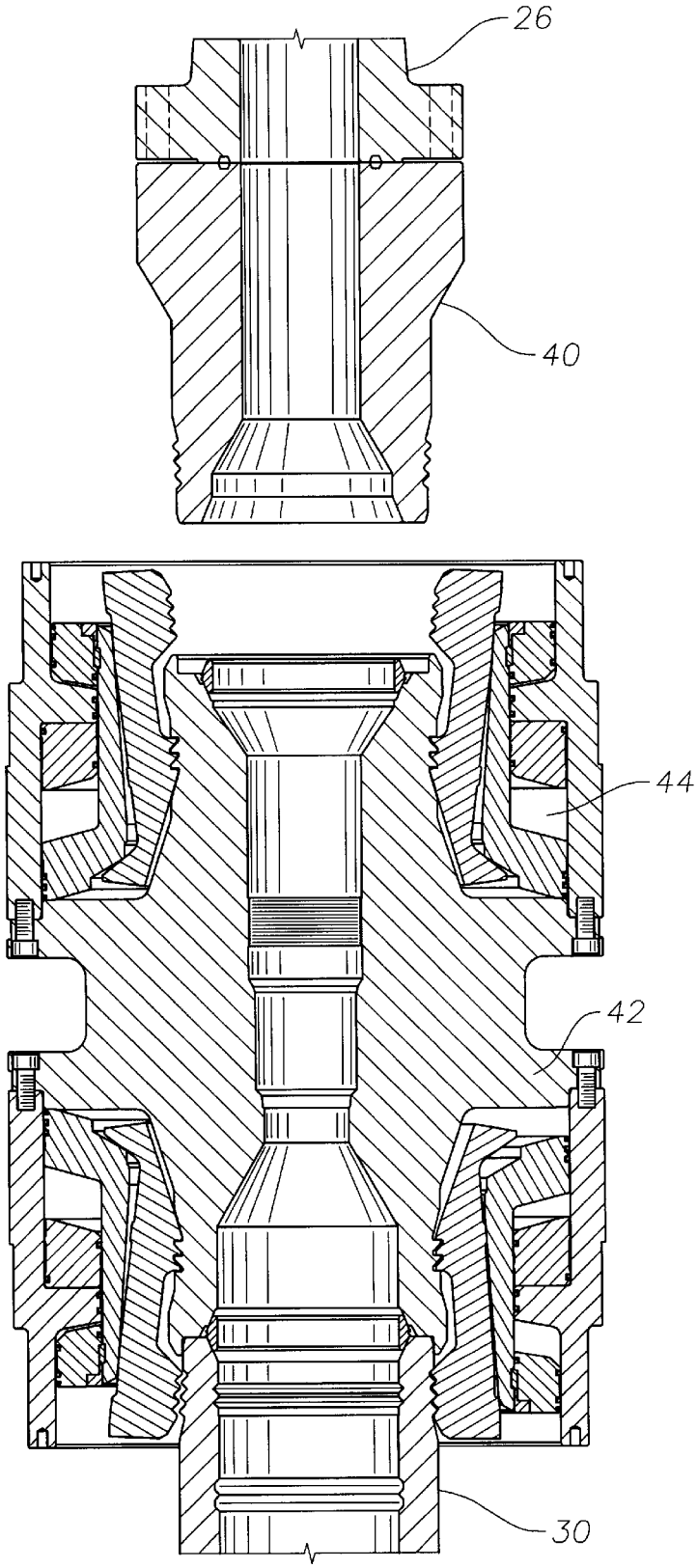
FIG. 3 is an elevation view, in section, of the two hydraulically actuated connectors of the present invention as an integral structure.
Figure 4:
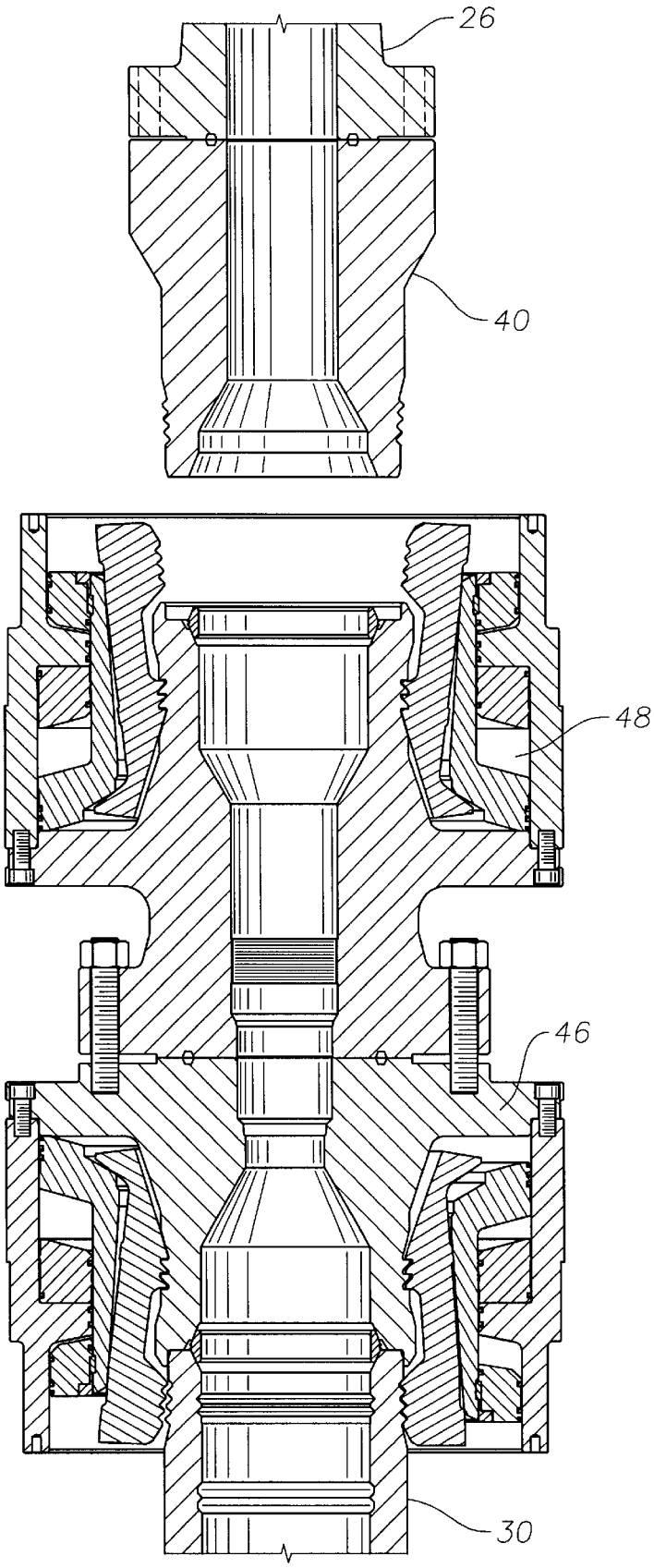
FIG. 4 is an elevation view, in section, of the two hydraulically actuated connectors of the present invention as separate structures sealingly connected.

The lower end of riser string 26 includes end connection member 40 that is secured to subsea wellhead housing 30. The details of how this is accomplished are best seen is FIGS. 3 and 4. FIG. 3 shows hydraulically actuated connectors 42 and 44 formed as an integral unit. Hydraulically actuated connectors 42 and 44 are well known in the art and use a pressurized hydraulic fluid source (not shown) to operate them between locked and unlocked positions. Hydraulically actuated connector 42 connects and seals to subsea wellhead housing 30. Hydraulically actuated connector 44 is facing upward to receive end connection member 40 secured to the lower end of riser string 26 by suitable means as bolting. Prior designs have had this situation reversed with end connection member 40 positioned on the top of hydraulically actuated connector 42 and hydraulically actuated connector 44 positioned on the end of riser string 26. The prior design thereby required a much larger bore 34 in buoyancy air tanks 18. The current invention allows the smaller diameter end connection member to be positioned on the riser string and thereby use a smaller bore in the buoyancy air tanks. A separate or non-integral design is shown in FIG. 4 with hydraulically actuated connector 46 separate from hydraulically actuated connector 48. Connectors 46 and 48 are sealingly attached to each other by suitable means as bolting.

A typical method of use for the current invention would be as follows. Floating vessel 10 is positioned over subsea structure 28 to allow connecting riser string 26 between floating vessel 10 and subsea structure 28. Subsea wellhead housing 30 with hydraulically actuated connectors 42 and 44 sealingly attached is secured on subsea structure 28. Floating vessel 10 with lower framework 14 has a plurality of well slots 16 therein. Guide sleeves 20 are positioned vertically along well slots 16 and extend to the lower end of floating vessel 10. A plurality of buoyancy air tanks 18 with a through bore that allows passage of riser string 26 with end connection member 40 attached are placed in the well slots 16.

Buoyancy air tanks 18 are secured in end to end engagement with the uppermost buoyancy air tank with stem joint 22 extending therefrom. Stem joint stop 32 is placed on stem joint 22 to coact with lower framework 14 to limit upward movement of buoyancy air tanks 18 when tanks 18 are deballasted. Riser string 26 is lowered in sections through stem joint 22 and bore 34 of buoyancy air tanks 18 until riser string 26 with end connection member 40 at its lower end reaches upwardly facing hydraulically actuated connector 42. Hydraulically actuated connector 42 is actuated to seal and lock riser string 26 and end connection member 40 to subsea wellhead housing 28. The upper end of riser string 26 is connected to stem joint 22 whereby deballasting of buoyancy air tanks 18 vertically tensions riser string 26.

Figure 5:
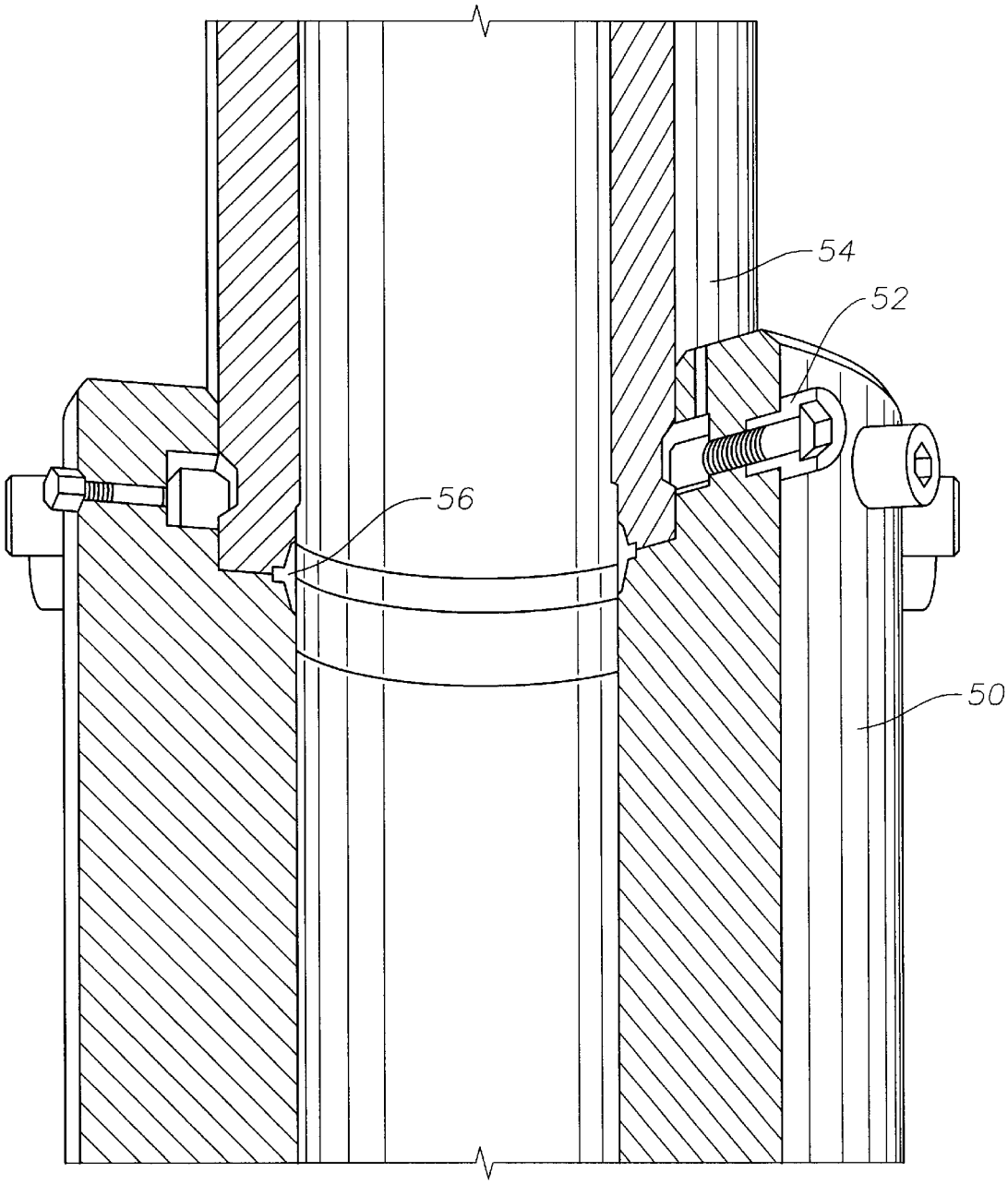
FIG. 5 is an elevation view, in section, of a single mechanical connector of the present invention as an integral structure to the wellhead sealingly connected to the riser.

FIG. 5 shows an alternative embodiment utilizing a mechanical connector integrally formed on the wellhead housing in place of hydraulically actuated connector 42 locking onto subsea wellhead housing 30. Integral mechanical connector wellhead housing 50 is shown in a vertical orientation secured to the seafloor as in the previous embodiments. Integral mechanical connector wellhead housing 50 includes a mechanical connector 52 formed on the upper end thereof. The upper end of integral mechanical connector wellhead housing 50 is profiled to accept end connector member 54 with seal 56 interposed therein. In all respects, integral mechanical connector wellhead housing 50 and end connection member 54 functions as in the previous embodiments.

Figure 6:
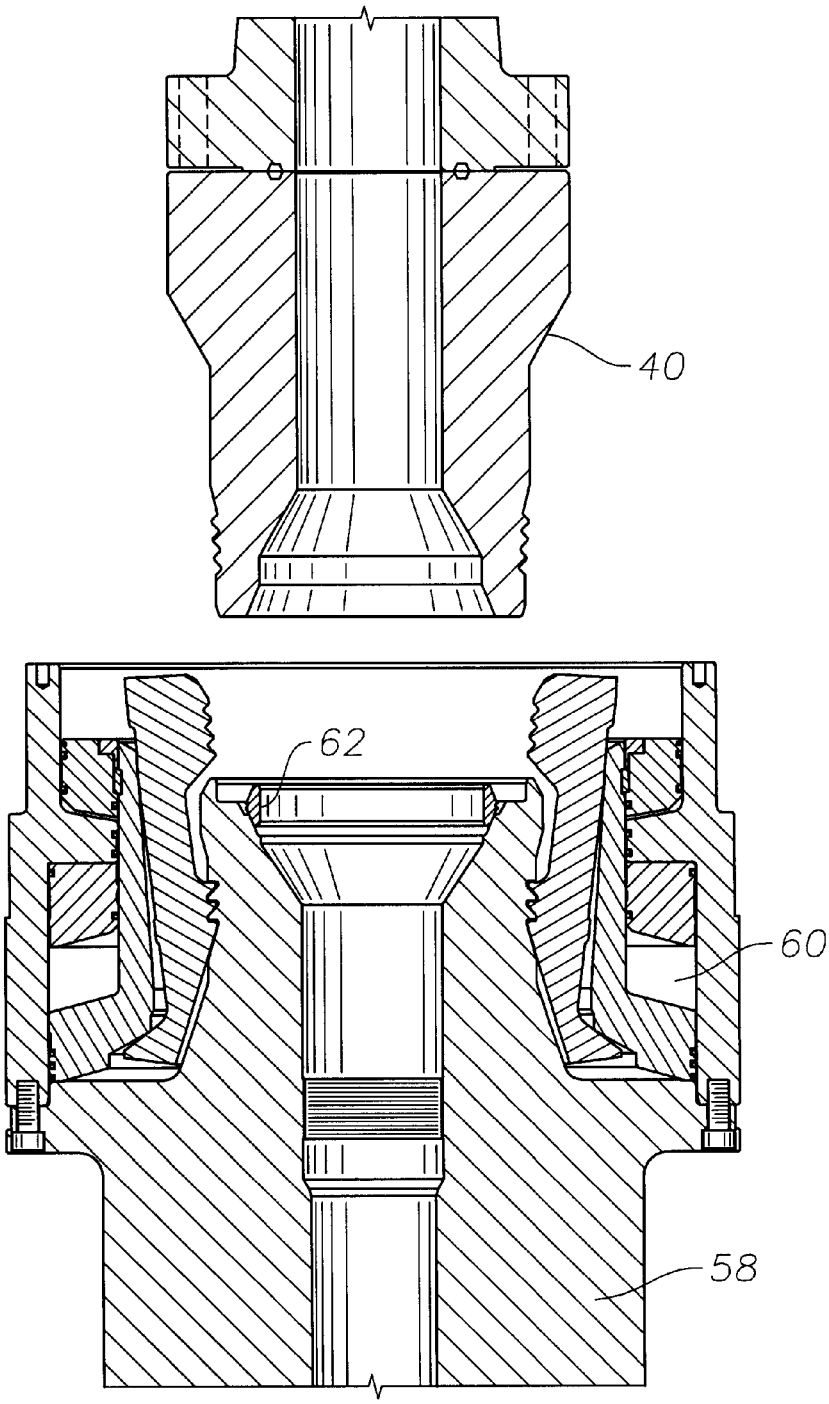
FIG. 6 is an elevation view, in section, of a single hydraulic connector of the present invention as an integral structure to the wellhead sealingly connected to the riser.

FIG. 6 shows an alternative embodiment utilizing a hydraulic connector integrally formed on the wellhead housing. Integral hydraulic connector wellhead housing 58 is shown in a vertical orientation secured to the seafloor as in the previous embodiments. Integral hydraulic connector wellhead housing 58 includes a hydraulically actuated connector 60 formed on the upper end thereof. The upper end of integral hydraulic connector wellhead housing 58 is profiled to accept end connector member 40 with seal 62 interposed therein. In all respects, integral hydraulic connector wellhead housing 58 and end connection member 40 function as in the previous embodiments.

The construction of my apparatus and method for connecting riser between a floating vessel and a subsea structure will be readily understood from the foregoing description and it will be seen that I have provided an apparatus and method for connecting riser between a floating vessel and a subsea structure that reduces the size of the air tanks used and thereby allow closer positioning of the well slots and overall reduction in size of the floating vessel. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. An apparatus for connecting a riser between a floating vessel and a subsea structure, said apparatus comprising:

a subsea structure anchored to the sea floor, said subsea structure including a subsea wellhead housing with a hydraulically actuated connector sealingly attached;

said subsea structure including a second hydraulically actuated connector; said second hydraulically actuated connector sealingly attached to said hydraulically actuated connector sealingly attached to said subsea wellhead housing;

a riser string extending from said subsea structure to a floating vessel, said riser string including an end connection member at its lower end for sealing engagement with said second hydraulically actuated connector;

said floating vessel having a lower framework, said lower framework having a plurality of well slots therein, said well slots including a plurality of guide sleeves vertically positioned within said lower framework and extending to the lower end of said floating vessel; and, at least one of said well slots having a plurality of buoyancy air tanks positioned therein, said buoyancy air tanks vertically arranged to fit within said plurality of guide sleeves positioned within said lower framework, said buoyancy air tanks having a through bore that allows passage of said riser string with said end connection member attached.

2. An apparatus for connecting a riser between a floating vessel and a subsea structure according to claim 1 wherein:

said buoyancy air tanks are connected in end to end engagement; and, the uppermost buoyancy air tank having a stem joint extending therefrom.

3. An apparatus for connecting a riser between a floating vessel and a subsea structure according to claim 2, wherein:

said stem joint includes a stem joint stop positioned thereon, said stem joint stop coacting with said lower framework to limit upward movement of said buoyancy air tanks when said buoyancy air tanks are deballasted.

4. An apparatus for connecting a riser between a floating vessel and a subsea structure according to claim 3, wherein:

said riser string is connected to said stem joint whereby deballasting of said buoyancy air tanks vertically tensions said riser string.

5. An apparatus for connecting a riser between a floating vessel and a subsea structure according to claim 4, wherein:

said connection between said riser string and said stem joint includes a wellhead housing sealingly attached to said riser string.

6. An apparatus for connecting a riser between a floating vessel and a subsea structure according to claim 5, wherein:

said wellhead housing includes a tubing hanger positioned therein; and, said tubing hanger having a string of tubing attached thereto and extending to said subsea structure.

7. An apparatus for connecting a riser between a floating vessel and a subsea structure according to claim 6, wherein:

said first and second hydraulically actuated connectors are integrally formed.

8. An apparatus for connecting a riser between a floating vessel and a subsea structure according to claim 7, wherein:

said floating vessel is a deep draft caisson vessel.

9. A system for connecting a production riser between a deep draft caisson vessel and a subsea wellhead housing, said system comprising:

a subsea wellhead housing secured to the sea floor;

a hydraulically actuated tieback connector sealingly attached to said subsea wellhead housing;

a second hydraulically actuated tieback connector sealingly attached to said hydraulically actuated tieback connector sealingly attached to said subsea wellhead housing;

a riser string extending from said subsea wellhead housing to a deep draft caisson vessel, said riser string including an end connection member at its lower end for sealing engagement with said second hydraulically actuated tieback connector;

said deep draft caisson vessel having a lower framework, said lower framework having a plurality of well slots therein, said well slots including a plurality of guide sleeves vertically positioned within said lower framework and extending to the lower end of said deep draft caisson vessel; and, at least one of said well slots having a plurality of buoyancy air tanks positioned therein, said buoyancy air tanks vertically arranged to fit within said plurality of guide sleeves positioned within said lower framework, said buoyancy air tanks having a through bore that allows passage of said riser string with said end connection member attached.

10. A system for connecting a production riser between a deep draft caisson vessel and a subsea wellhead housing according to claim 9 wherein:

said buoyancy air tanks are secured in end to end engagement; and, the uppermost buoyancy air tank has a stem joint extending therefrom.

11. A system for connecting a production riser between a deep draft caisson vessel and a subsea wellhead housing according to claim 10 wherein:

said stem joint includes a stem joint stop positioned thereon, said stem joint stop coacting with said lower framework to limit upward movement of said buoyancy air tanks when said buoyancy air tanks are deballasted.

12. A system for connecting a production riser between a deep draft caisson vessel and a subsea wellhead housing according to claim 11 wherein:

said riser string is connected to said stem joint whereby deballasting of said buoyancy air tanks vertically tensions said riser string.

13. A system for connecting a production riser between a deep draft caisson vessel and a subsea wellhead housing according to claim 12 wherein:

said connection between said riser string and said stem joint includes a wellhead housing sealingly attached to said riser string.

14. A system for connecting a production riser between a deep draft caisson vessel and a subsea wellhead housing according to claim 13 wherein:

said wellhead housing includes a wellhead christmas tree positioned thereon, said wellhead christmas tree includes a tubing hanger positioned therein; and, said tubing hanger having a string of tubing attached thereto and extending to said subsea wellhead housing.

15. A system for connecting a production riser between a deep draft caisson vessel and a subsea wellhead housing according to claim 14 wherein:

said first and second hydraulically actuated tieback connectors are integrally formed.

16. A method for connecting a riser between a floating vessel and a subsea structure, comprising the steps of:

positioning a floating vessel over a subsea structure to allow connecting a riser between said floating vessel and said subsea structure;

positioning a subsea wellhead housing with a hydraulically actuated connector sealingly attached on said subsea structure;

attaching a second hydraulically actuated connector in sealing engagement to said hydraulically actuated connector sealingly attached to said subsea wellhead housing;

providing said floating vessel with a lower framework having a plurality of well slots therein;

positioning vertically a plurality of guide sleeves within said lower framework and extending said plurality of guide sleeves to the lower end of said floating vessel;

installing a plurality of buoyancy air tanks within at least one of said well slots and arranging said plurality of buoyancy air tanks to fit within said plurality of guide sleeves positioned within said lower framework; and, providing said buoyancy air tanks with a through bore that allows passage of said riser with an end connection member attached.

17. A method for connecting a riser between a floating vessel and a subsea structure, according to claim 16 further comprising the steps of:

securing said buoyancy air tanks in end to end engagement; and, providing the uppermost buoyancy air tank with a stem joint extending therefrom.

18. A method for connecting a riser between a floating vessel and a subsea structure, according to claim 17 further comprising the steps of:

positioning a stem joint stop on said stem joint to coact with said lower framework to limit upward movement of said buoyancy air tanks when said buoyancy air tanks are deballasted.

19. A method for connecting a riser between a floating vessel and a subsea structure, according to claim 18 further comprising the steps of:

running said riser through said stem joint and said buoyancy air tanks through bore until said riser end connection member reaches said second hydraulically actuated connector; and, actuating said second hydraulically actuated connector to connect said riser to said subsea structure.

20. A method for connecting a riser between a floating vessel and a subsea structure, according to claim 19 further comprising the steps of:

connecting said riser string to said stem joint whereby deballasting of said buoyancy air tanks vertically tensions said riser string.

21. An apparatus for connecting a riser between a floating vessel and a subsea structure, said apparatus comprising:

a subsea structure anchored to the sea floor, said subsea structure including a subsea wellhead housing with a first securing means sealingly attached;

said subsea structure including a second securing means; said second securing means sealingly attached to said first securing means sealingly attached to said subsea wellhead housing;

a riser string extending from said subsea structure to a floating vessel, said riser string including an end connection member at its lower end for sealing engagement with said second securing means;

said floating vessel having a lower framework, said lower framework having a plurality of well slots therein, said well slots including a plurality of guide sleeves vertically positioned within said lower framework and extending to the lower end of said floating vessel;

at least one of said well slots having a plurality of buoyancy air tanks positioned therein, said buoyancy air tanks vertically arranged to fit within said plurality of guide sleeves positioned within said lower framework, said buoyancy air tanks having a through bore that allows passage of said riser string with said end connection member attached;

said buoyancy air tanks are connected in end to end engagement, the uppermost buoyancy air tank having a stem joint extending therefrom; and, said stem joint includes a stem joint stop positioned thereon, said stem joint stop coacting with said lower framework to limit upward movement of said buoyancy air tanks when said buoyancy air tanks are deballasted.

22. An apparatus for connecting a riser between a floating vessel and a subsea structure according to claim 21, wherein:

said riser string is connected to said stem joint whereby deballasting of said buoyancy air tanks vertically tensions said riser string.

23. An apparatus for connecting a riser between a floating vessel and a subsea structure according to claim 22, wherein:

said connection between said riser string and said stem joint includes a wellhead housing sealingly attached to said riser string.

24. An apparatus for connecting a riser between a floating vessel and a subsea structure according to claim 23, wherein:

said wellhead housing includes a tubing hanger positioned therein; and, said tubing hanger having a string of tubing attached thereto and extending to said subsea structure.

25. An apparatus for connecting a riser between a floating vessel and a subsea structure according to claim 24, wherein:

said first and second hydraulically actuated connectors are integrally formed.

26. An apparatus for connecting a riser between a floating vessel and a subsea structure according to claim 25, wherein:

said floating vessel is a deep draft caisson vessel.

27. An apparatus for connecting a riser between a floating vessel and a subsea structure, said apparatus comprising:

a subsea structure anchored to the sea floor, said subsea structure including a subsea wellhead housing with a first mechanical connector sealingly attached;

said subsea structure including a second mechanical connector, said second mechanical connector sealingly attached to said first mechanical connector sealingly attached to said subsea wellhead housing;

a riser string extending from said subsea structure to a floating vessel, said riser string including an end connection member at its lower end for sealing engagement with said second mechanical connector;

said floating vessel having a lower framework, said lower framework having a plurality of well slots therein, said well slots including a plurality of guide sleeves vertically positioned within said lower framework and extending to the lower end of said floating vessel;

at least one of said well slots having a plurality of buoyancy air tanks positioned therein, said buoyancy air tanks vertically arranged to fit within said plurality of guide sleeves positioned within said lower framework, said buoyancy air tanks having a through bore that allows passage of said riser string with said end connection member attached;

said buoyancy air tanks are connected in end to end engagement, the uppermost buoyancy air tank having a stem joint extending therefrom; and, said stem joint includes a stem joint stop positioned thereon, said stem joint stop coacting with said lower framework to limit upward movement of said buoyancy air tanks when said buoyancy air tanks are deballasted.

28. An apparatus for connecting a riser between a floating vessel and a subsea structure according to claim 27, wherein:

said riser string is connected to said stem joint whereby deballasting of said buoyancy air tanks vertically tensions said riser string.

29. An apparatus for connecting a riser between a floating vessel and a subsea structure according to claim 28, wherein:

said connection between said riser string and said stem joint includes a wellhead housing sealingly attached to said riser string.

30. An apparatus for connecting a riser between a floating vessel and a subsea structure according to claim 29, wherein:

said wellhead housing includes a tubing hanger positioned therein; and, said tubing hanger having a string of tubing attached thereto and extending to said subsea structure.

31. An apparatus for connecting a riser between a floating vessel and a subsea structure according to claim 30, wherein:

said first and second hydraulically actuated connectors are integrally formed.

32. An apparatus for connecting a riser between a floating vessel and a subsea structure according to claim 31, wherein:

said floating vessel is a deep draft caisson vessel.

33. A system for connecting a production riser between a deep draft caisson vessel and a subsea wellhead housing, said system comprising:

a subsea wellhead housing secured to the sea floor;

a first securing means sealingly attached to said subsea wellhead housing;

a second securing means sealingly attached to said first securing means sealingly attached to said subsea wellhead housing;

a riser string extending from said subsea wellhead housing to a deep draft caisson vessel, said riser string including an end connection member at its lower end for sealing engagement with said second securing means;

said deep draft caisson vessel having a lower framework, said lower framework having a plurality of well slots therein, said well slots including a plurality of guide sleeves vertically positioned within said lower framework and extending to the lower end of said deep draft caisson vessel;

at least one of said well slots having a plurality of buoyancy air tanks positioned therein, said buoyancy air tanks vertically arranged to fit within said plurality of guide sleeves positioned within said lower framework, said buoyancy air tanks having a through bore that allows passage of said riser string with said end connection member attached;

said buoyancy air tanks are secured in end to end engagement, the uppermost buoyancy air tank has a stem joint extending therefrom; and, said stem joint includes a stem joint stop positioned thereon, said stem joint stop coacting with said lower framework to limit upward movement of said buoyancy air tanks when said buoyancy air tanks are deballasted.

34. A system for connecting a production riser between a deep draft caisson vessel and a subsea wellhead housing according to claim 33 wherein:

said riser string is connected to said stem joint whereby deballasting of said buoyancy air tanks vertically tensions said riser string.

35. A system for connecting a production riser between a deep draft caisson vessel and a subsea wellhead housing according to claim 34 wherein:

said connection between said riser string and said stem joint includes a wellhead housing sealingly attached to said riser string.

36. A system for connecting a production riser between a deep draft caisson vessel and a subsea wellhead housing according to claim 35 wherein:

said wellhead housing includes a wellhead christmas tree positioned thereon, said wellhead christmas tree includes a tubing hanger positioned therein; and, said tubing hanger having a string of tubing attached thereto and extending to said subsea wellhead housing.

37. A system for connecting a production riser between a deep draft caisson vessel and a subsea wellhead housing according to claim 36 wherein:

said first and second securing means are integrally formed.

38. A system for connecting a production riser between a deep draft caisson vessel and a subsea wellhead housing, said system comprising:

a subsea wellhead housing secured to the sea floor;

a first mechanical connector sealingly attached to said subsea wellhead housing;

a second mechanical connector sealingly attached to said first mechanical connector sealingly attached to said subsea wellhead housing;

a riser string extending from said subsea wellhead housing to a deep draft caisson vessel, said riser string including an end connection member at its lower end for sealing engagement with said second mechanical connector;

said deep draft caisson vessel having a lower framework, said lower framework having a plurality of well slots therein, said well slots including a plurality of guide sleeves vertically positioned within said lower framework and extending to the lower end of said deep draft caisson vessel;

at least one of said well slots having a plurality of buoyancy air tanks positioned therein, said buoyancy air tanks vertically arranged to fit within said plurality of guide sleeves positioned within said lower framework, said buoyancy air tanks having a through bore that allows passage of said riser string with said end connection member attached;

said buoyancy air tanks are secured in end to end engagement, the uppermost buoyancy air tank has a stem joint extending therefrom; and, said stem joint includes a stem joint stop positioned thereon, said stem joint stop coacting with said lower framework to limit upward movement of said buoyancy air tanks when said buoyancy air tanks are deballasted.

39. A system for connecting a production riser between a deep draft caisson vessel and a subsea wellhead housing according to claim 38 wherein:

said riser string is connected to said stem joint whereby deballasting of said buoyancy air tanks vertically tensions said riser string.

40. A system for connecting a production riser between a deep draft caisson vessel and a subsea wellhead housing according to claim 39 wherein:

said connection between said riser string and said stem joint includes a wellhead housing sealingly attached to said riser string.

41. A system for connecting a production riser between a deep draft caisson vessel and a subsea wellhead housing according to claim 40 wherein:

said wellhead housing includes a wellhead christmas tree positioned thereon, said wellhead christmas tree includes a tubing hanger positioned therein; and, said tubing hanger having a string of tubing attached thereto and extending to said subsea wellhead housing.

42. A system for connecting a production riser between a deep draft caisson vessel and a subsea wellhead housing according to claim 41 wherein:

said first and second mechanical connectors are integrally formed.

43. An apparatus for connecting a riser between a floating vessel and a subsea structure, said apparatus comprising:

a subsea structure anchored to the sea floor, said subsea structure including a subsea wellhead housing with a first securing means integrally formed on said subsea wellhead housing;

a riser string extending from said subsea structure to a floating vessel, said riser string including an end connection member at its lower end for sealing engagement with said securing means;

said floating vessel having a lower framework, said lower framework having a plurality of well slots therein, said well slots including a plurality of guide sleeves vertically positioned within said lower framework and extending to the lower end of said floating vessel;

at least one of said well slots having a plurality of buoyancy air tanks positioned therein, said buoyancy air tanks vertically arranged to fit within said plurality of guide sleeves positioned within said lower framework, said buoyancy air tanks having a through bore that allows passage of said riser string with said end connection member attached;

said buoyancy air tanks are connected in end to end engagement, the uppermost buoyancy air tank having a stem joint extending therefrom; and, said stem joint includes a stem joint stop positioned thereon, said stem joint stop coacting with said lower framework to limit upward movement of said buoyancy air tanks when said buoyancy air tanks are deballasted.

44. An apparatus for connecting a riser between a floating vessel and a subsea structure according to claim 43, wherein:

said riser string is connected to said stem joint whereby deballasting of said buoyancy air tanks vertically tensions said riser string.

45. An apparatus for connecting a riser between a floating vessel and a subsea structure according to claim 44, wherein:

said connection between said riser string and said stem joint includes a wellhead housing sealingly attached to said riser string.

46. An apparatus for connecting a riser between a floating vessel and a subsea structure according to claim 45, wherein:

said wellhead housing includes a tubing hanger positioned therein; and, said tubing hanger having a string of tubing attached thereto and extending to said subsea structure.

47. An apparatus for connecting a riser between a floating vessel and a subsea structure according to claim 46, wherein:

said floating vessel is a deep draft caisson vessel.

* * * * *